United States Patent [19]

Nishimura et al.

[11] 4,415,359

[45] Nov. 15, 1983

[54] MULTI-STEP STEELMAKING REFINING METHOD

[75] Inventors: Mitsuhiko Nishimura; Morikatsu Sakurada, both of Kamaishi, Japan

[73] Assignee: Nippon Steel Corporation, Tokyo, Japan

[21] Appl. No.: 361,615

[22] Filed: Mar. 25, 1982

[30] Foreign Application Priority Data

Mar. 30, 1981 [JP] Japan ..... 56/47023

[51] Int. Cl.[3] ..... C21C 7/00

[52] U.S. Cl. ..... 75/60

[58] Field of Search ..... 75/60, 46

[56] References Cited

U.S. PATENT DOCUMENTS 3,854,932 12/1974 Bishop ..... 75/60

*Primary Examiner*—P. D. Rosenberg

*Attorney, Agent, or Firm*—Cushman, Darby & Cushman

[57] ABSTRACT

The impurities of molten pig iron produced by a blast furnace are removed exclusively in a converter, according to the conventional steelmaking refining method.

The desulfurization and dephosphorization, which have been conventionally achieved in a converter, are replaced by the desulfurization and dephosphorization during the pretreatment of the molten pig iron, according to recently developed steelmaking methods. In the multi-step steelmaking refining method, such oxygen-blowing as that employed for the conventional converter would result in a rather violent spitting and reduction in recovery of iron.

It is an object of the present invention to provide a multi-phase steelmaking refining method, in which decarburization is carried out without causing the disadvantages in the prior art.

The objects of the present invention are achieved by the following:

(1) the decarburization of molten pig iron, which has been desiliconized and dephosphorized, is carried out in a reaction vessel (1) by means of an oxygen top blowing method; and, (2) a stirring fluid is blown beneath the level of the molten pig iron within the reaction vessel (1) during the decarburization treatment at a stirring power of not less than 400 watts per ton of the molten pig iron.

10 Claims, 6 Drawing Figures

MULTI-STEP STEELMAKING REFINING METHOD

Figure 1:
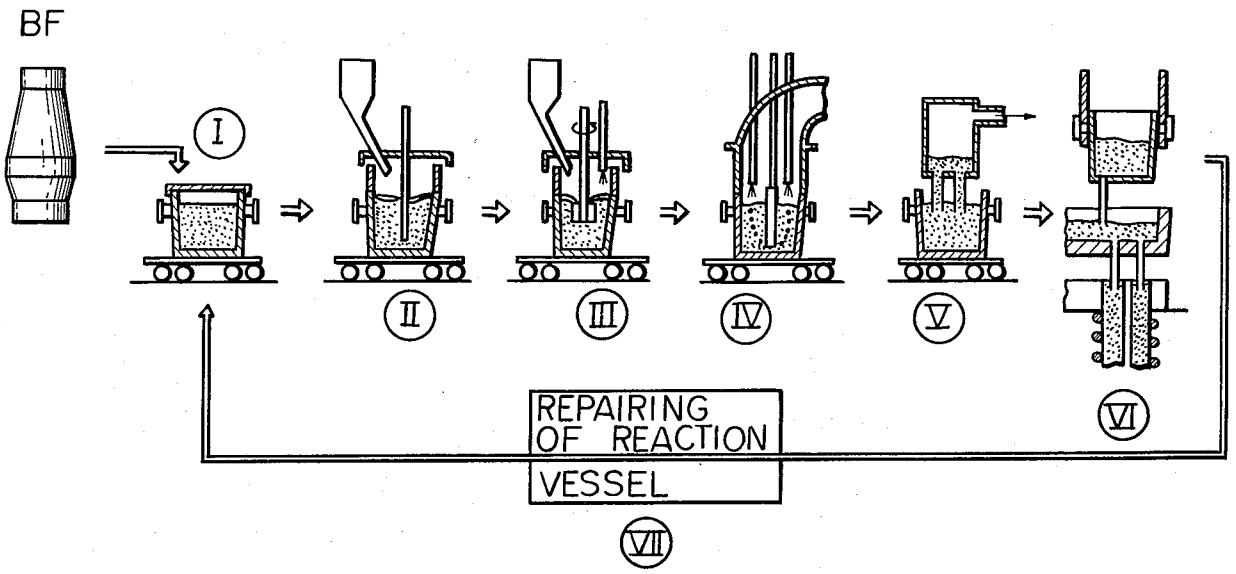

The present invention relates to a multi-step steelmaking refining method, particularly, a multi-step steelmaking refining method which comprises the step of decarburizing a molten pig iron which has been desiliconized and dephosphorized. More particularly, the multi-step steelmaking refining method comprises separate and successive steps for desiliconization, dephosphorization and decarburization.

The impurities of molten pig iron produced by a blast furnace are removed exclusively in a converter, according to the conventional steelmaking refining method, by means of pure-oxygen being blown into the converter. In other words, the function of removing the impurities is concentrated on the converter refining. More specifically, the desiliconization, dephosphorization, desulfurization and decarburization reactions proceed in a converter concurrently or successively to one another. Since the impurities to be removed have chemical properties different from each other, and since the removal reactions take place concurrently or successively, it is not always possible for the conditions in a converter to be suitable for the removal of each impurity to be removed. More specifically, silicon, which is one of the impurities to be removed, is oxidized to $SiO_2$ usually in the initial oxygen-blowing period of a converter, so that a slag layer having a low basicity (the ratio of $CaO/SiO_2$) is formed. This slag having a low basicity is not suitable for the removal of phosphorus and sulfur. In order to carry out the dephosphorization and desulfurization, the basicity of the slag must be maintained at a high level. According to a practice employed for this purpose, a large amount of auxiliary materials, mainly composed of lime, is incorporated in a converter. This causes the generation of an enormous amount of slag, for example, from 100 to 130 kg per ton of molten steel, which, in turn, brings about the following problems.

1. Due to the large amount of slag generated in a converter, the slopping phenomena during the blowing period is promoted and thus the recovery of iron is decreased. When one attempts to prevent the slopping phenomena, it is necessary to install an excessively large free-board, with the result that not only the weight of the converter vessel and amounts of refractories used are increased, but also the time required for the construction and repairing of converter vessel is increased. As a result, low productivity occurs.

2. Iron oxide in the slag is increased proportionally to the amount of slag generated, and, therefore, the recovery of iron is decreased.

3. In accordance with the increase in the amount of slag generated, heat lost as the sensible heat of slag is increased and, thus, the thermal efficiency of the steelmaking refining process is decreased, which, in turn, leads to an unavoidable decrease in the ratio of scraps to be loaded to the molten pig iron.

In order to eliminate the above-mentioned problems, it is possible to pretreat molten pig iron before the converter refining so that various impurities are removed from the pig iron. Two pretreatments have been mainly developed regarding the removal of sulfur and phosphorus from molten pig iron. In other words, the pretreatments heretofore developed have focussed on removing sulfur and phosphorus from the molten pig iron before it is put into the converter, so that it is not necessary to carry out these processes in the converter. The desulfurization and dephosphorization, which have been conventionally achieved in a converter, are therefore replaced by the desulfurization and dephosphorization during the pretreatment of the molten pig iron, according to recently developed steelmaking methods. In a case when the desiliconization, which has been conventionally achieved in a converter, is replaced with the desiliconization by pretreatment, it is possible to considerably decrease the amount of a slag forming agent put into the converter and, thus, the amount of the slag generated in the converter is also considerably decreased, thereby further removing the problems mentioned above.

In the most advanced multi-step steelmaking refining method at present, the steps of desiliconization, dephosphorization and decarburization are successively carried out. Desulfurization can be carried out at any time of the steelmaking refining method. For example, desulfurization can be carried out either once or twice simultaneously with the dephosphorization step, between the desiliconization and dephosphorization steps, or after the decarburization step. Even in this most advanced multi-step steelmaking refining method, however, decarburization is accomplished in a conventional converter after the pretreatment of the molten pig iron for removing silicon, and phosphorus and occasionally sulfur in a ladle or torpedo car has been completed. In this case, since reloading of the melt is necessary at the time the molten pig iron is loaded into a converter and tapped from the converter, such problems as generation of dust at the reloading and lowering in the temperature due to reloading are caused, which, in turn, causes a decrease in the thermal efficiency.

In addition, a problem occurs during decarburization in a conventional converter according to the multi-step steelmaking refining method, since the amount of slag generated in the converter is drastically smaller than the slag generated during the conventional steelmaking refining method, so that when the molten pig iron, which is virtually uncovered, is subjected to the decarburization blowing, it is likely to eject upwards due to the oxygen jet. In the multi-step steelmaking refining method, such oxygen-blowing as that employed for the conventional converter would result in a rather violent spitting and reduction in recovery of iron.

It is an object of the present invention to provide a multi-step steelmaking refining method, in which decarburization is carried out without causing the disadvantages in the prior art.

The objects of the present invention are achieved by the following:

(1) the decarburization of molten pig iron, which has been desiliconized and dephosphorized, is carried out in a reaction vessel by means of an oxygen top blowing method; and, (2) a stirring fluid is blown beneath the level of the molten pig iron within the reaction vessel during the decarburization treatment at a stirring power of not less than 400 watts per ton of the molten pig iron.

For the decarburization of the desiliconized and dephosphorized pig iron, no slag-forming agent is necessary, as a rule, in a reaction vessel, such as a ladle, and therefore it is possible to overcome the problems arising in the conventional converter steelmaking method. In other words, the molten pig iron, which is the starting material of the decarburization treatment, is a pretreated molten pig iron which has been desiliconized and dephosphorized and, occasionally, has also been desulfurized to a predetermined level. The molten pig iron subjected to the pretreatment mentioned above has a silicon content of usually not less than 0.20%, and desirably only a trace, and also has a phosphorus content not exceeding the value specified regarding the finished steel. The present invention is not limited to a specific pretreatment method, and any known pretreatment method can be carried out. In addition, any known treatment of decarburized steel may be carried out in the multi-step steelmaking refining method of the present invention. This treatment, which is carried out after the decarburization treatment, is hereinafter referred to as a post treatment. Regarding sulfur, the sulfur content can be decreased to a value lower than the value specified for the finished steel by means of the following methods, which are selected depending upon the specific purpose of the steel. That is, the molten pig iron can be subjected to a desulfurization pretreatment, a desulfurization post treatment, or a combination of the desulfurization-pretreatment and post treatment, which combination is employed for producing high grade steels required to have a low sulfur content.

As described hereinabove, spitting is likely to occur when decarburization blowing is carried out when no slag, or only a small amount of slag, is present on the surface of the melt. The so-called soft blow, in which oxygen is calmly blown and transmitted to the surface of the melt, effectively suppresses spitting. Incidentally, since, in the method of the present invention, only decarburization is carried out while on a melt slag is essentially absent, direct contact of the oxygen with the molten pig iron is easy. Therefore, in an embodiment of the present invention, oxygen top blowing is carried out by a super soft blow, which cannot achieve effective decarburization in the conventional converter steelmaking method. It is also possible to drastically suppress spitting, while the decarburization reaction is effectively promoted, due to the stirring explained in detail hereinbelow.

In one embodiment, which is preferable since decarburizing can be accomplished in a short period of time, oxygen top blowing is carried out by means of a multi-aperture lance and/or a plurality of lances, thereby dispersing the oxygen jet on the surface of the melt and thus decreasing the depth of the cavity formed by the oxygen jet (L) of the oxygen jet into the melt. This embodiment is effective for supplying the oxygen to the melt at a high rate and maintaining the advantages of the super soft blow.

In the conventional converter steelmaking method, the oxygen jet is required to have both a function of supplying oxygen to cause the refining reactions and a function of stirring the melt so as to enhance the reaction efficiency. The oxygen jet of the conventional converter steelmaking method, therefore, involves a problem in that the stirring function, which should enhance and promote the reaction, leads instead to spitting. In order to avoid such a problem, the two functions of the oxygen jet, mentioned above, are distinctly divided so that the top blowing oxygen jet is provided only to supply the oxygen and a stirring fluid is employed only to stir the melt. More specifically, the super soft blow is so inadequate for stirring molten pig iron that a large iron oxide layer tends to form on the surface of the melt, and, further, the ratio of supplied oxygen combining with the carbon during decarburization, which is referred to as the decarburization reaction ratio, is decreased. In order to maintaining the advantages of the super soft blow and simultaneously eliminate the disadvantages due to the absence of the stirring function, it is necessary to employ a stirring method apart from the top blowing of the oxygen. This is achieved by introducing a stirring fluid beneath the level of the molten pig iron in a reaction vessel.

In an embodiment of the present invention, the stirring fluid is blown through one or more immersion lances.

In an embodiment of the present invention, the stirring fluid is blown through one or more of tuyeres or gas-permeable plugs situated in the reaction vessel beneath the level of the molten pig iron.

The blowing rate of the stirring fluid must be such that a stirring state, in terms of stirring power, of at least 400 watt/ton, preferably at least 800 watt/ton, be ensured. The stirring power is calculated by the following stirring parameter ($\dot{\varepsilon}$).

$$\dot{\varepsilon}=0.0285\ (Q\cdot T/W)\ \log\ (1+H/148),$$

wherein:

Q is the flow rate of the stirring fluid in l/min;

T is temperature of the melt in K;

W is the weight of the melt in tons; and,

H is the depth the melt is blown in cm.

It is not necessary to maintain a stirring power of at least 400 watt/ton over the entire decarburization blowing period, but it is necessary to do so at least during the initial or early stage.

The decarburization blowing, in which spitting is drastically suppressed due to the super soft blow, is advantageously achieved in the present invention, and, therefore, a considerably greater amount of molten pig iron can be loaded in a converter than that able to be loaded in a conventional converter refining method.

In an embodiment of the present invention, the reaction vessel mentioned above is a ladle for molten pig iron, which may be provided with a means for blowing the stirring fluid, and this ladle contains the molten pig iron in a filling ratio which is of a usual value. The usual amount of molten pig iron loaded in a pig iron ladle, for example from 60 to 80% based on the volume of the pig iron ladle, is considerably higher than the usual amount of molten pig iron loaded in a converter according to a conventional decarburization blowing method. Although the decarburization blowing method according to said embodiment is carried out under a high loading condition, the decarburization blowing can be carried out effectively without causing a decrease in the recovery of iron. It is therefore unnecessary according to the decarburization blowing method of the present invention, to use such an excessively large apparatus as a converter, since the steelmaking refining steps can be effectively carried out in a compact apparatus or apparatuses.

In an embodiment of the present invention, by using the single reaction vessel mentioned above, the steps starting at receiving the molten pig iron from a blast furnace and ending at the casting of the molten steel can be carried out. These steps may include successively the desiliconization step, the dephosphorization or simultaneous dephosphorization and desulfurization step, and the decarburization step. In the embodiment now described the reaction vessel, such as a molten pig iron ladle, has both a role of transporting the melt and a role of supplying a place where the refining reactions take place. It is therefore possible to continuously use the reaction vessel from a time when the reaction vessel receives the molten pig iron from the blast furnace until a time when either the continuous casting method or the usual casting method for forming ingots is carried out, without reloading the melt. Between the two times mentioned above, the treatments of desiliconization, dephosphorization, desulfurization and decarburization can be carried out by a multi-step refining method. In a steelmaking plant, in which torpedo cars are installed, the desiliconization step and the dephosphorization, or simultaneous dephosphorization and desulfurization step, can be successively carried out in the torpedo cars, and subsequently, before the initiation of the decarburization step, the molten pig iron is reloaded from the torpedo cars into a reaction vessel, which is a reaction vessel other than the torpedo cars. The decarburization blowing is then carried out in the reaction vessel. If necessary, the desulfurization and adjusting of the steel chemistry can be carried out in this reaction vessel, followed by a casting step. In the multi-step steelmaking refining method by means of torpedo cars and a reaction vessel, the melt must be reloaded once. However, this method is also advantageous, because the decarburization step is carried out according to the present invention.

Methods for decreasing the times of reloading the melt or making the reloading unnecessary are previously known. According to one of these methods, known in Japanese laid-open patent application No. 54-130420 of Oct. 9, 1979, a ladle receives the molten pig iron tapped and this molten pig iron is directly loaded in a converter without reloading of the melt. According to another known method, molten pig iron, which has been desiliconized, dephosphorized and desulfurized in one vessel, is decarburized in a converter. According to another method, known from Japanese laid-open patent application No. 51-27811 of Mar. 9, 1976, refining is continuously carried out in a transportable refining ladle. However, since in the former two methods a converter is necessary in a sequence of the refining steps, two reloading operations are necessary, i.e. at the step of reloading into the converter and at the step of reloading from the converter into a casting ladle. These two methods, therefore, still involve problems in that a large amount of heat is lost and dust is generated during the reloading operations. In addition, since the decarburization blowing of these two methods is a conventional method of decarburization, the recovery of iron is low. In the latter method, although the problems of heat loss and dust generation are solved, various problems resulting from slag, such as a large amount of the slag generated, remain unsolved because the molten pig iron is not pretreated and is subjected to the steelmaking reactions which are basically the same as the conventional ones.

In an embodiment of the present invention, the stirring fluid is at least one member selected from the group consisting of carbon dioxide gas, argon, nitrogen gas and oxygen gas. The nitrogen gas, however, should not be used for producing a grade of steel in which the nitrogen content is required to be very low. Since the oxygen may erode the refractories of the gas-permeable plugs, the cooling of such plugs is advisable.

In an embodiment of the present invention, a removable free board is installed on the reaction vessel at the decarburization period.

Several of the embodiments will now be described more quantitatively or specifically.

In the super soft blowing, a characteristic parameter of the oxygen jet ($L/L_o$) cannot be more than 0.3, wherein $L_o$ is the depth of a stationary melt within a reaction vessel in mm and L is the depth of the cavity formed by the oxygen jet in mm determined by the following formulae.

$$L = L_h \cdot \exp(-0.78\, h/L_h) \text{ and}$$

$$L_h = 63.0(kFo_2/nd)^{\frac{2}{3}}.$$

In these formulae;

L is an infiltration depth of the oxygen jet into the melt in mm;

h is the distance between the lance(s) and the surface of the melt in mm;

$Fo_2$ is the flow rate of oxygen in $Nm^3/h$;

n is the number of apertures (nozzles) in each lance;

d is the diameter of each aperture (nozzles) in mm; and k is the calibration coefficient depending upon the injection angle $\theta$ from the the lance axis as follows.

In a case when n is 1 ($n=1$), $k=1.0$. In a case when n is 2 or more ($n \geqq 2$), $k=1.7$ at $\theta=0°$, $k=1.4$ at $\theta=6°$, and $k=1.0$ at $\theta=10°$.

In the conventional converter, the depth of a stationary melt within a converter ($L_o$) is, at the highest, from approximately 0.1 to 0.3 times the effective inner height of the converter ($L_t$), and, therefore, most of the effective inner height ($L_t$) of the converter is a so-called free board, where the converter wall does not come in contact with the melt. According to the present invention, in which heavy loading in the decarburization step is achieved, the ratio of $L_o/L_t$ can be 0.6 or more ($L_o/L_t \geqq 0.6$). In this case, the maximum ratio of $L_o/L_t$ is limited, so that height of the melt, which is stirred due to the decarburization blowing, does not exceed the height of the free board. When the maximum height of the stirred melt measured from the level of the stationary one during the decarburization blowing is expressed by $L_s$, the maximum ratio of $L_o/L_t$ is limited, so that the relationship of $L_o/L_t < 1 - L_s/L_t$ is satisfied. If the heavy loading of present invention is carried out in the conventional converter steelmaking method, problems caused by swelling of the slag, slopping and spitting become serious. Therefore, in the conventional converter, the loading of pig iron is limited, so that the relationship of $L_o/D_o < 0.5$ is satisfied, wherein $D_o$ is the effective inner diameter of the converter. Contrary to this, the decarburization blowing is possible, even in a case when $L_o/D_o \geqq 0.5$. This means that the decarburization treatment capacity of a reaction vessel having a predetermined dimension can be significantly increased, as compared with that in the conventional converter refining method, which is a commercially useful point.

In order to stir the melt, not only gas, but also liquid, such as liquid oxygen and liquid carbon dioxide, as well as mixture of a gas and a liquid can be used as the stirring fluid. The volume expansion at the gasification of the liquid is highly effective for stirring the melt.

As understood from the description hereinabove, the multi-step steelmaking refining method of the present invention comprises a novel decarburization step which does not rely at all on the conventional converter steelmaking method. Since one of the advantages of the present invention resides in a very simplified process starting at the receipt of the molten pig iron from a blast furnace and ending at the pouring and solidification of the steel, the present invention is greatly advantageous to the steelmaking industry.

The preferred embodiments of the present invention will now be described with reference to the following drawings.

Figure 2:
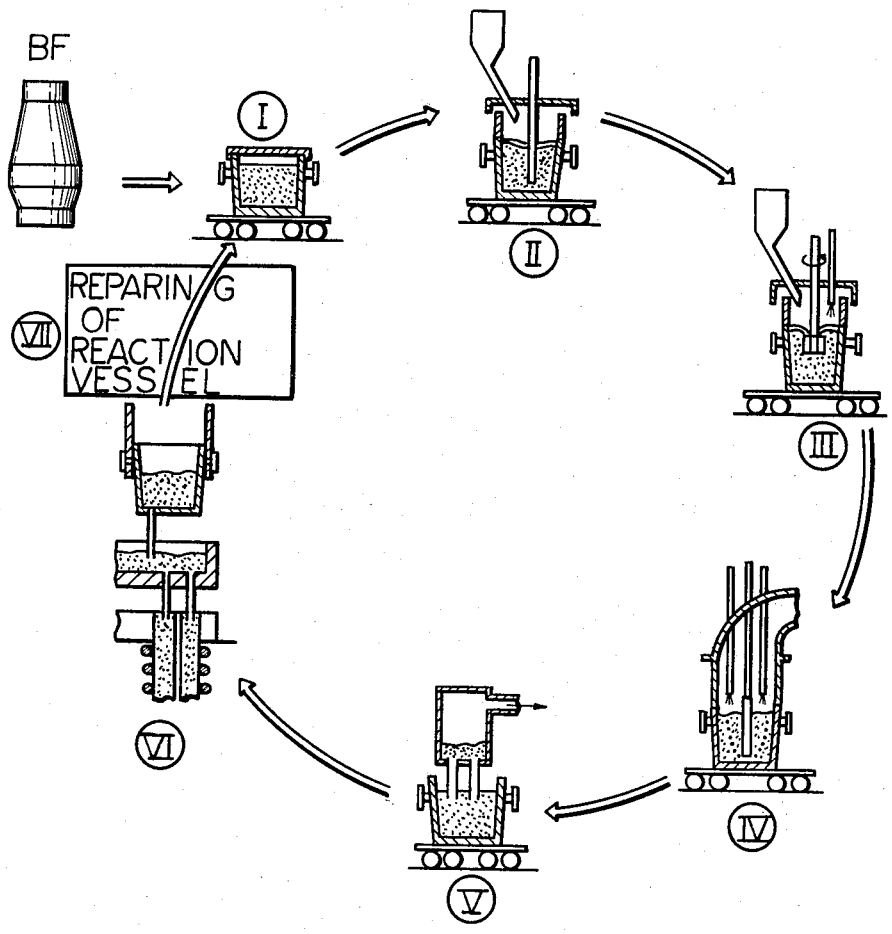

FIG. 1 and FIG. 2 schematically illustrate preferred embodiments of the multi-step steel making refining method of the present invention.

Figure 3:
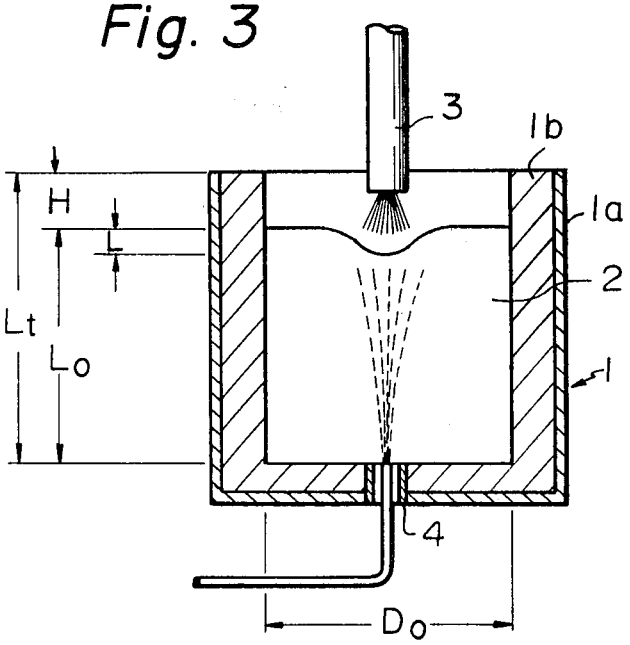
Figure 4:
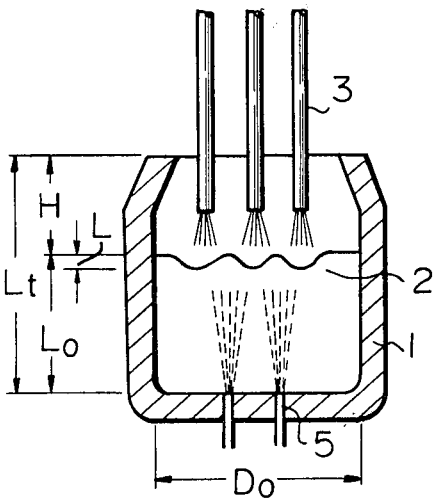
Figure 5:
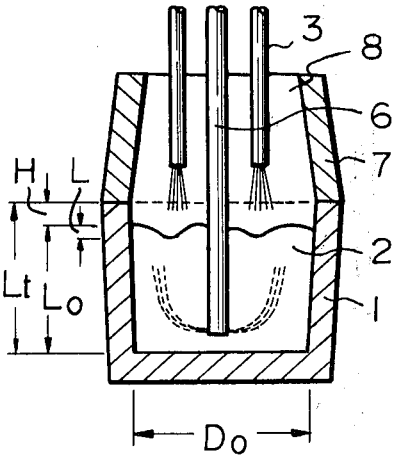

FIGS. 3 through 5 illustrate reaction vessels in which the decarburization blowing is being carried out.

Figure 6:
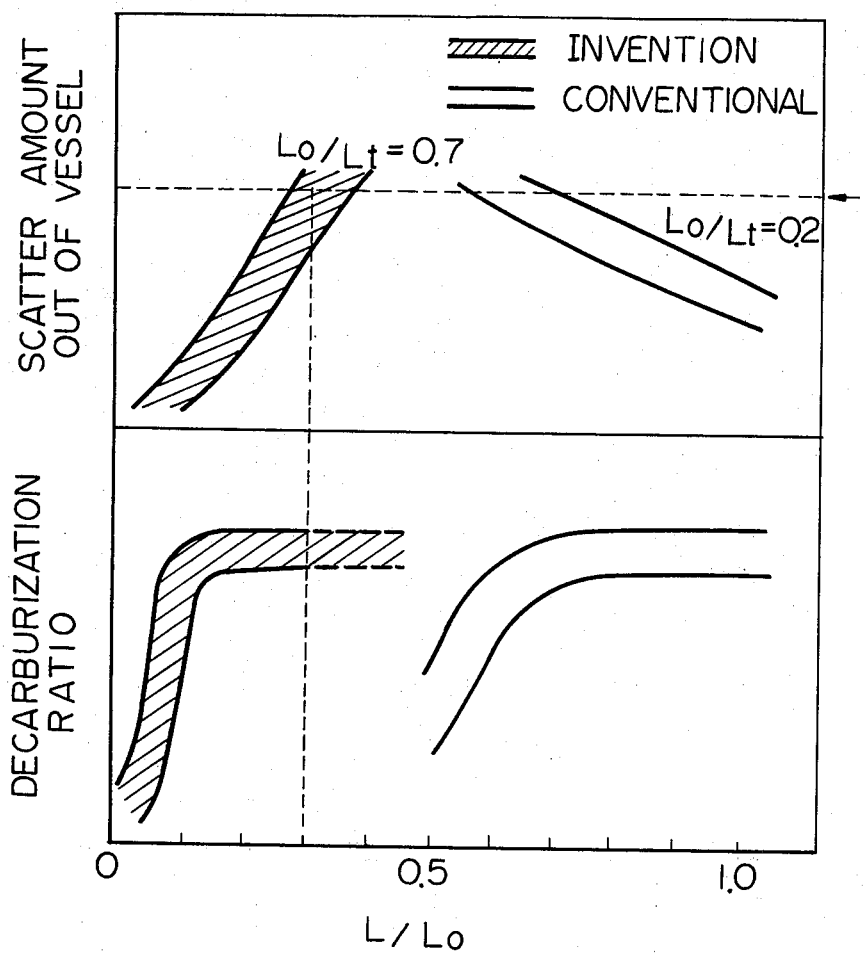

FIG. 6 is a graph illustrating the relationship between the characteristic parameter of the oxygen jet of ($L/L_o$) and the decarburization ratio which defines the carbon decarburization reaction ratio, relative to the amount of oxygen supplied. In FIG. 6, the relationship is shown between the characteristic parameter of oxygen jet ($L/L_o$) and the amount of molten steel scattered out of a reaction vessel due to spitting, etc. In FIG. 6, the ratios of $L_o/L_t$ according to the present invention and the conventional method are 0.7 and 0.2, respectively.

Referring to FIGS. 1 and 2, it will be understood that the multi-step refining is carried out in the following sequence:

I—A reaction vessel receives molten pig iron from the blast furnace (BF).

II (Desiliconization Step) The desiliconization is carried out, for example by means of the oxygen injection method.

III (Dephosphorization and/or Desulfurization Step) For example, a method of admixing flux by means of a mechanical stirring method or an oxygen-injection method while incorporating flux is carried out.

IV (Decarburization Step) Decarburization by the super soft blow method is carried out and the melt is stirred by a stirring fluid, which is, for example, blown through an immersion lance.

V (Adjusting Step of Steel Chemistry) For example, RH degassing is carried out.

VI (Casting Step) Finished steel is cast by a continuous casting method.

VII The reaction vessel is hot-repaired and waits the tapping from the blast furnace.

It will be apparent from the above description that one reaction vessel has the roles of transporting, storing, pouring and being the place where the refining reactions take place. In FIG. 1, the stations of refining, casting and the like are arranged linearly, while in FIG. 2 these stations are arranged in a circle.

Referring to FIG. 3, a preferred embodiment of the decarburization blowing is schematically illustrated. In FIG. 1, the reaction vessel is composed of the metal shell 1*a* and refractory lining 1*b* and contains therein the melt 2. The depth of the melt 2 is $L_o$ when the melt is stationary. The reaction vessel has the effective inner height $L_t$ which is shown in FIG. 3. The oxygen is blown through the top blowing lance 3 by a super soft blow. One gas-permeable refractory plug 4 is provided at the bottom of the reaction vessel 1 so as to blow the stirring fluid into the melt 2. The oxygen blown from the top blowing lance 3 makes the cavities onto the melt 2 by a depth of L. The melt 2 is basically molten pig iron, since if the slag forming agent is used, it is used only to the extent that the oxides resultant from the oxygen blowing cannot erode the refractory lining 1*b*. The symbols of H and $D_o$ in FIG. 3 denote the hight of the freeboard and the effective inner diameter of the reaction vessel. If necessary, a plurality of the top blowing lances 3 and a plurality of the gas-permeable refractory plugs may be used.

Referring to FIG. 4, three top blowing lances 3 are used for blowing the oxygen and the bottom of reaction vessel 1 is provided with two blowing tuyeres 5 instead of the gas-permeable refractory plug 4 for blowing the stirring fluid. Referring to FIG. 5, two top blowing lances 3 are used for oxygen blowing and the stirring fluid is blown through the immersion lance 6. A removable side wall, i.e. free board 7, is installed on the reaction vessel, so as to form an inner space 8 defined by the inner wall of the free board 7 and thus spitting of melt 2 out of the inner space 8 is prevented.

Referring to FIG. 6, the present invention and conventional methods having different ratios of $L_o/L_t$ different from one another are compared with one another regarding the amount of melt scattered out of the reaction vessel and the variation of the decarburization reaction ratio vary depending upon the characteristic parameter of oxygen jet ($L/L_o$). In FIG. 6, the ratios of $L_o/L_t$ of the present invention-and conventional-methods are 0.7 and 0.2, respectively. In case of the conventional converter, the characteristic parameter of oxygen jet ($L/L_o$) is usually set between 0.7 and 1.0. As is apparent from FIG. 6 the super soft blow of present invention in terms of characteristic parameter of oxygen jet ($L/L_o$) is not more than 0.3, which is the preferable maximum value for keeping the recovery of iron, and the decarburization reaction in the conventional converter steelmaking method virtually does not take place. More specifically, the term "super soft blow" can be explained by the concept that the decarburization reaction ratio is virtually zero when the melt is not subjected to stirring by the stirring fluid blown into the melt.

As is also apparent from the lower half of FIB. 6, the decarburization reaction ratio is at the ideal level. This is because the oxygen is brought into a direct contact with the melt and the stirring mentioned above is carried out.

The present invention will now be explained by way of Examples.

EXAMPLE 1

Table 1 shows the average steel chemistry of six heats, when the multi-step steelmaking method comprising the desiliconization, simultaneous dephosphorization and desulfurization, and decarburization steps were carried out. Each heat consisted of 60 ton of molten pig iron and 6 ton of scraps. An increase in the phosphorus content after the decarburization step is not considered to be the result of the rephosphorization. The recovery of iron and the amount of slag generated are shown in Table 2.

TABLE 1

| Steps | C % | Si % | Mn % | P % | S % | | Remarks |
|---|---|---|---|---|---|---|---|
| Tapping from Blast Furnace | 4.34 | 0.35 | 0.47 | 0.079 | 0.030 | | — |
| After Desiliconization | 4.20 | 0.10 | 0.25 | 0.079 | 0.031 | Scraps 10% Scale 10 kg/t | |

TABLE 1-continued

| Steps | C % | Si % | Mn % | P % | S % | Remarks | |
|---|---|---|---|---|---|---|---|
| After Dephosphorization and Desulfurization | 4.00 | tr | 0.22 | 0.015 | 0.015 | $O_2$: 5 $Nm^3/t$<br>CaO: 15 kg/t<br>$O_2$: 2 $Nm^3/t$<br>Iron Ore 25 kg/t | |
| After Decarburization | 0.60 | tr | 0.22 | 0.017 | 0.015 | Three Lances<br>CaO: 5 kg/t<br>$O_2$: 40 $Nm^3/t$ | One Immersion Lance<br>Ar: 1.5 $Nm^3/min$<br>Stirring Power<br>456 watt/t |
| After adjusting the Steel Chemistry | 0.62 | 0.20 | 0.60 | 0.017 | 0.015 | RH Degassing<br>Fe—Mn: 5.6 kg/t<br>Fe—Si: 3.0 kg/t | |

TABLE 2

| | Conventional (A) | Invention (B) | Difference (B − A) |
|---|---|---|---|
| Recovery of Iron (Molten Steel) | 94.6% | 96.3% | +1.7% |
| Amount of Slag Generated | 100 kg/t | 60 kg/t | −40 kg/t |

The term "Conventional (A)" in Table 2 indicates a conventional converter steelmaking method.

EXAMPLE 2

The procedure of Example 1 was repeated except for the decarburization step as is apparent from Table 3. The recovery of iron by the present invention is considerably higher than that of the comparative tests.

TABLE 3

| | Test | Number of Top-Blowing Lance(s) | Means for Blowing Stirring Fluid | Stirring Fluid | $O_2$ Amount per Ton of Steel ($Nm^3/T$) | Flow Rate or Stirring Fluid ($Nm^3/min$) | Stirring Power (watt/t) | Recovery of Steel (Molten Steel) (%) |
|---|---|---|---|---|---|---|---|---|
| Invention | 1 | 3 | One Immersion Lance | Ar gas | 40.3 | 1.4 | 425 | 96.1 |
| | 2 | 3 | One Immersion Lance | " | 40.0 | 2.0 | 607 | 96.5 |
| | 3 | 3 | Three Plugs (Bottom Blowing) | " | 39.7 | 3.5 | 1062 | 96.7 |
| | 4 | 2 | Three Plugs (Bottom Blowing) | " | 41.2 | 2.7 | 820 | 96.3 |
| | 5 | 2 | One Immersion Lance | $CO_2$ gas | 40.5 | 0.9 | 410 | 96.1 |
| | 6 | 5 | One Immersion Lance | Ar gas | 41.1 | 2.0 | 607 | 96.2 |
| Comparative Example | 7 | 3 | One Immersion Lance | " | 40.8 | 0.7 | 213 | 94.9 |
| | 8 | 3 | none | none | 42.5 | 0 | 0 | 94.0 |
| | 9 | 1 | One Immersion Lance | Ar gas | 43.0 | 1.5 | 456 | 94.8 |
| | 10 | 1 | One Immersion Lance | " | 41.5 | 0.6 | 182 | 94.6 |
| | 11 | 1 | none | none | 42.0 | 0 | 0 | 94.5 |

EXAMPLE 3

In the present example, the multi-step refining method comprised the desiliconization, dephosphorization, decarburization and desulfurization steps. The resultant steel chemistry and refining condition in each step are shown in Table 4, and the recovery of iron and amount of slag generated are shown in Table 5.

TABLE 4

| Steps | C % | Si % | Mn % | P % | S % | Remarks | |
|---|---|---|---|---|---|---|---|
| Tapping from Blast Furnace | 4.34 | 0.35 | 0.47 | 0.079 | 0.030 | | — |
| After Desiliconization | 4.20 | 0.10 | 0.25 | 0.079 | 0.031 | Scraps 10%<br>Scale 10 kg/t | $O_2$: 5 $Nm^3/t$ |
| After Dephosphorization | 4.00 | tr | 0.22 | 0.015 | 0.017 | CaO: 12 kg/t<br>$CaCl_2$: 1.5 kg/t | Iron Oxide 20 kg/t<br>$O_2$: 2 $Nm^3/t$ |
| After Decarburization | 0.60 | tr | 0.22 | 0.015 | 0.017 | Three Lances<br>CaO: 5 kg/t<br>$O_2$: 40 $Nm^3/t$ | One Immersion Lance<br>Ar: 1.5 $Nm^3/min$<br>456 watt/t |
| After Desulfurization | 0.60 | tr | 0.22 | 0.015 | 0.008 | CaO: 5.0 kg/t<br>Ar: 1.4 $Nm^3/t$ | CaO Powder Injection |
| After adjusting the Steel Chemistry | 0.62 | 0.20 | 0.60 | 0.015 | 0.008 | RH Degassing | Fe—Mn 5.6 kg/t<br>Fe—Si 3.0 kg/t |

TABLE 5

| | Conventional (A) | Invention (B) | Difference (B − A) |
|---|---|---|---|
| Recovery of Iron (Molten Steel) | 94.6% | 96.5% | +1.9% |
| Amount of Slag Generated | 100 kg/t | 60 kg/t | −40 kg/t |

EXAMPLE 4

The procedure of Example 3 was repeated except for the decarburization step as apparent from Table 6.

TABLE 6

| | Test No. | Number of Top Blowing Lance(s) | Means for Blowing Stirring Fluid | Stirring Fluid | $O_2$ Amount per Ton of Steel ($Nm^3/T$) | Flow Rate or Stirring Fluid ($Nm^3/min$) | Stirring Power (watt/t) | Recovery of Iron (Molten Steel) (%) |
|---|---|---|---|---|---|---|---|---|
| Invention | 12 | 3 | One Immersion Lance | $N_2$ gas | 40.8 | 2.5 | 760 | 96.3 |
| | 13 | 2 | One Plug (Bottom Blowing) | $O_2$ gas | 39.3 | 2.3 | 1047 | 96.6 |
| | 14 | 3 | Three Plugs (Bottom Blowing) | Ar + $O_2$ =4:1 | 40.1 | 1.5 | 501 | 96.2 |

EXAMPLE 5

In the present example shown in Table 7 "Invention" indicates the decarburization blowing of the desiliconized, dephosphorized and desulfurized molten pig iron which was loaded in a reaction vessel at the ratio of $L_o/L_t=0.7$. In addition "Conventional" indicates a conventional converter refining of molten pig iron which was loaded in the converter at the ratio of $L_o/L_t=0.2$. In the method of the present invention, the amount of slag generated is very small because no auxiliary raw materials are used at all, and the recovery of iron is high.

TABLE 7

| | Invention | | | | | Conventional | | | | |
|---|---|---|---|---|---|---|---|---|---|---|
| $L_0/L_t$ | 0.7 | | | | | 0.2 | | | | |
| $L/L_0$ | 0.2 | | | | | 0.8 | | | | |
| Oxygen Flow Rate | 120 $Nm^3$/Hr.t | | | | | 130 $Nm^3$/Hr.t | | | | |
| Flow Rate of Ar for Stirring | 0.19 $Nm^3$/min.t | | | | | — | | | | |
| Number of (Oxygen) Top Blowing Lance | 3 | | | | | 1 | | | | |
| Auxiliary Raw Materials (CaO) | — | | | | | 50.4 kg/t | | | | |
| Auxiliary Raw Materials ($CaF_2$) | — | | | | | 3.9 kg/t | | | | |
| Amount of Slag Generated | 5 Kg/t | | | | | 120 Kg/t | | | | |
| Steel Chemistry (%) | C | Si | Mn | P | S | C | Si | Mn | P | S |
| Pig Iron Chemistry | 3.78 | tr | 0.25 | 0.020 | 0.015 | 4.50 | 0.43 | 0.29 | 0.079 | 0.022 |
| Analysis at the End of | 0.08 | tr | 0.16 | 0.020 | 0.015 | 0.08 | tr | 0.16 | 0.021 | 0.015 |
| Temperature at the End of Decarburization Blowing | 1640° C. | | | | | 1635° C. | | | | |
| Recovery of Iron (Molten Steel) | 97.1% | | | | | 95.3% | | | | |

EXAMPLE 6

In the present example shown in Table 8, "Invention" and "Conventional" indicate the decarburization blowing method, in which the liquid oxygen was blow as the stirring gas, and the decarburization blowing method, in which no stirring gas was blown, respectively.

TABLE 8

| | Invention | | | | | Conventional | | | | |
|---|---|---|---|---|---|---|---|---|---|---|
| Top Blowing Lance(s) | Three Lances (Multi-Lances) | | | | | Single Lance with Apertures (Nozzles) | | | | |
| Oxygen-Flow Rate | 46 $Nm^3$/t | | | | | 49 $Nm^3$/t | | | | |
| Flow Rate of Liquid Oxygen through a Single Immersion Lance | 1.4 l/min | | | | | — | | | | |
| $L/L_0$ | 0.15 | | | | | 0.88 | | | | |
| Time of Refining Period of Time | 18 minutes | | | | | 20 minutes | | | | |
| Amount of Molten Pig Iron | 60 t | | | | | 60 t | | | | |
| Amount of Scraps | 6 t | | | | | 6 t | | | | |
| Recovery of Iron (Molten Steel) | 97% | | | | | 95% | | | | |
| Molten-Steel Chemistry | C | Si | Mn | P | S | C | Si | Mn | P | S |
| | 0.31 | 0.15 | 0.62 | 0.015 | 0.015 | 0.32 | 0.16 | 0.62 | 0.017 | 0.015 |

As will be understood from the description hereinabove, especially the Examples, an excessively large apparatus, such as a converter, is no longer necessary in refining pig iron and an increase in the recovery of iron can be achieved, according to the present invention. Since reloading of the melt is no longer necessary or if necessary, reloading is limited to only one or possibly two times, the generation of dust is decreased and thermal efficiency is increased. Since the amount of slag generated in accordance with the method of the present invention is considerably smaller than generated in the conventional converter steelmaking method, the slag processing apparatus can be very compact.

Furthermore, the free oxygen content of the steel at the end of the oxygen blowing process is lower as compared with that the conventional steelmaking method, which contributes to the recovery of alloying elements, as well as to the recovery of iron.

We claim:

1. A multi-step steelmaking refining method, comprising:

(a) tapping molten pig iron from a blast furnace into a reaction vessel;

(b) in said vessel, desiliconizing and dephosphorizing said molten pig iron;

(c) in said vessel, decarburizing the desiliconized and dephosphorized molten pig iron, by:

(i) soft top-blowing oxygen onto the upper surface of such molten pig iron through a plurality of apertures which are so diversely aimed as to more widely disperse the oxygen impacting the surface of such molten pig iron, and to form a cavity of lesser depth therein, than would result from top-blowing the same amount of oxygen per unit time onto said surface through a single aperture; while (ii) stirring such molten pig iron by blowing a stirring fluid thereinto from beneath said upper surface at a stirring rate, at least in an initial stage of this decarburizing step (c), of at least 400 watts per ton of such molten pig iron;

(d) sometime between conducting steps (a) and (e), desulfurizing said molten pig iron; and (e) casting resulting molten steel from said vessel.

2. A method according to claim 1, wherein:

said stirring fluid is blown through at least one tuyere situated in said reaction vessel beneath said molten pig iron.

3. A method according to claim 1, wherein:

said stirring fluid is blown through at least one gas permeable plug situated in said reaction vessel beneath said molten pig iron.

4. A method according to claim 1, wherein:

by the time step (c) is begun, at least a substantial portion of step (d) has already been conducted, and the upper surface of the desiliconized and diphosphorized molten pig iron is substantially free slag.

5. A method according to claim 1, wherein said stirring fluid is blown through at least one immersion lance.

6. A method according to claim 1, wherein said reaction vessel is a ladle for molten pig iron and said ladle for molten pig iron contains the molten pig iron in a filling ratio which is of a usual value.

7. A method accordiang to claim 6, wherein said ladle for molten pig iron is provided with a means for blowing said stirring fluid.

8. A method according to claim 1, 2, or 3 wherein said stirring fluid is at least one fluid selected from the group consisting of carbondioxide gas, argon, nitrogen gas and oxygen gas.

9. A method according to claim 1 or 2, wherein a removable free board is installed on said reaction vessel throughout conduction of the decarburization step.

10. A method according to claim 1, wherein the stirring power is not less than 800 watts/ton.

* * * * *